US008201766B2

(12) United States Patent
Chen

(10) Patent No.: US 8,201,766 B2
(45) Date of Patent: Jun. 19, 2012

(54) PINS OR STAPLES REMOVABLE STRUCTURE OF AUTOMATIC SHREDDERS

(75) Inventor: Hsin-Hsiung Chen, Shanghai (CN)

(73) Assignee: Aurora Office Equipment Co., Ltd., Shanghai (CN)

( * ) Notice: Subject to any disclaimer, the term of this patent is extended or adjusted under 35 U.S.C. 154(b) by 9 days.

(21) Appl. No.: 12/509,681

(22) Filed: Jul. 27, 2009

(65) Prior Publication Data

US 2010/0044484 A1 Feb. 25, 2010

(30) Foreign Application Priority Data

Aug. 19, 2008 (CN) ..... 2008 2 0152123 U

(51) Int. Cl.
*B02C 18/22* (2006.01)

(52) U.S. Cl. ..... 241/225; 241/236

(58) Field of Classification Search ..... 241/236, 241/100, 225, 81
See application file for complete search history.

(56) References Cited

U.S. PATENT DOCUMENTS

| | | | |
|---|---|---|---|
| 3,111,800 | A | 11/1963 | Quianthy |
| 3,629,530 | A | 12/1971 | Fischer |
| 3,724,766 | A | 4/1973 | Bosland |
| 3,728,501 | A | 4/1973 | Larson et al. |
| 3,746,815 | A | 7/1973 | Drummer |
| 3,769,473 | A | 10/1973 | Lay |
| 3,780,246 | A | 12/1973 | Beckering et al. |

(Continued)

FOREIGN PATENT DOCUMENTS

| | | |
|---|---|---|
| CN | 2372057 | 4/2000 |

(Continued)

OTHER PUBLICATIONS

J.L. Novak & J.T. Feddema, a capacitance-based proximity sensor for whole arm obstacle avoidance, Sandia National Laboratories Albuquerque NM 87185, Dec. 1992.

(Continued)

*Primary Examiner* — Mark Rosenbaum
(74) *Attorney, Agent, or Firm* — WHGC, PLC; John F. O'Rourke; Erick P. Wolf

(57) ABSTRACT

The present invention relates to a pins or staples removable structure of automatic shredders which comprises a shredder core, a paper press board assembly and a paper support board assembly fixed to the shredder core and arranged cooperatedly, and a clamping device, the paper support board assembly comprises a paper support board and a pick-up mechanism mounted to the paper support board, the clamping device is fixed to the paper press board assembly and the shredder core/the paper support board respectively, for clamping the paper to be shredded to the paper support board during the process of shredding paper, the paper support board has a paper inlet above the blade assembly of the shredder core, the distance between the outer end of the paper support board and the outer end of the pick-up mechanism for clamping the paper to be shredded is less than the length of the whole paper to be shredded, the pins or staples removable structure of automatic shredders further comprises a magnet positioned in the outer end of the paper support board, then the present invention, cooperated with the shredding structure of automatic shredders, can remove automatically pins or staples of paper having pins or staples mixed in a stack of paper, to achieve shredding paper in batches, has a high degree of automation, can be used conveniently, is designed dexterously, and has a concise structure and an economical cost.

10 Claims, 2 Drawing Sheets

U.S. PATENT DOCUMENTS

| | | | | |
|---|---|---|---|---|
| 3,785,230 | A | | 1/1974 | Lokey |
| 3,829,850 | A | | 8/1974 | Guetersloh |
| 3,860,180 | A | | 1/1975 | Goldhammer |
| 3,873,796 | A | | 3/1975 | Worobec et al. |
| 3,947,734 | A | | 3/1976 | Fyler |
| 3,952,239 | A | | 4/1976 | Owings et al. |
| 3,953,696 | A | | 4/1976 | Reimann et al. |
| 3,971,906 | A | | 7/1976 | Sahrbacker |
| 4,002,874 | A | | 1/1977 | Brown |
| 4,016,490 | A | | 4/1977 | Weckenmann et al. |
| 4,018,392 | A | | 4/1977 | Wagner |
| 4,062,282 | A | | 12/1977 | Miller et al. |
| 4,068,805 | A | | 1/1978 | Oswald |
| 4,082,232 | A | | 4/1978 | Brewer |
| 4,107,484 | A | | 8/1978 | Petersen, III |
| 4,117,752 | A | | 10/1978 | Yoneda |
| 4,125,228 | A | | 11/1978 | Brewer |
| 4,135,068 | A | | 1/1979 | Burns |
| 4,162,042 | A | | 7/1979 | Mommsen et al. |
| 4,172,400 | A | | 10/1979 | Brierley |
| 4,180,716 | A | | 12/1979 | Suzuki |
| 4,187,420 | A | | 2/1980 | Piber |
| 4,194,698 | A | | 3/1980 | Kosmowski |
| 4,262,179 | A | | 4/1981 | Bauer |
| 4,276,459 | A | | 6/1981 | Willett et al. |
| 4,277,666 | A | | 7/1981 | Vignaud |
| 4,349,814 | A | | 9/1982 | Akehurst |
| 4,423,844 | A | | 1/1984 | Sours et al. |
| 4,449,062 | A | | 5/1984 | Wilson |
| 4,471,915 | A | | 9/1984 | Levin et al. |
| 4,510,860 | A | | 4/1985 | LaBarge et al. |
| 4,518,958 | A | | 5/1985 | Cook et al. |
| 4,549,097 | A | | 10/1985 | Ulmer |
| 4,562,971 | A | | 1/1986 | Schwelling |
| 4,564,146 | A | | 1/1986 | Bleasdale |
| 4,598,182 | A | | 7/1986 | Breslin |
| 4,664,317 | A | | 5/1987 | Morton |
| 4,673,136 | A | | 6/1987 | Bianco et al. |
| 4,683,381 | A | | 7/1987 | Dufoug |
| 4,693,428 | A | | 9/1987 | Raterman et al. |
| 4,706,895 | A | | 11/1987 | Bricker |
| 4,709,197 | A | | 11/1987 | Goldhammer et al. |
| 4,713,509 | A | | 12/1987 | Chebowski |
| 4,751,603 | A | | 6/1988 | Kwan |
| 4,753,323 | A | | 6/1988 | Kahkipuro |
| 4,767,895 | A | | 8/1988 | Parrish |
| 4,771,359 | A | | 9/1988 | Link |
| 4,784,601 | A | | 11/1988 | Nitta |
| 4,784,602 | A | | 11/1988 | Nitta |
| 4,798,116 | A | | 1/1989 | Silver et al. |
| 4,821,967 | A | | 4/1989 | Moriyama |
| 4,824,029 | A | | 4/1989 | Stottmann et al. |
| 4,839,533 | A | | 6/1989 | Aga |
| 4,859,172 | A | | 8/1989 | Nitta |
| 4,882,458 | A | | 11/1989 | Berg et al. |
| 4,893,027 | A | | 1/1990 | Kammerer et al. |
| 4,893,759 | A | * | 1/1990 | Mizobata ..... 241/100 |
| 4,900,881 | A | | 2/1990 | Fischer |
| 4,910,365 | A | | 3/1990 | Kuo |
| 4,944,462 | A | | 7/1990 | Raterman et al. |
| 4,957,243 | A | * | 9/1990 | Kanagaki et al. ..... 241/34 |
| 4,982,058 | A | | 1/1991 | Schroeder et al. |
| 5,037,033 | A | | 8/1991 | Stottmann et al. |
| 5,044,270 | A | | 9/1991 | Schwelling |
| 5,045,648 | A | | 9/1991 | Fogleman, Sr. |
| 5,065,947 | A | | 11/1991 | Farnsworth |
| 5,081,406 | A | | 1/1992 | Hughes et al. |
| 5,100,067 | A | | 3/1992 | Konig et al. |
| 5,135,178 | A | | 8/1992 | Strohmeyer |
| 5,166,679 | A | | 11/1992 | Vranish et al. |
| 5,167,374 | A | | 12/1992 | Strohmeyer |
| 5,171,143 | A | | 12/1992 | Sohn |
| 5,186,398 | A | | 2/1993 | Vigneaux, Jr. |
| 5,207,392 | A | | 5/1993 | Stangenberg et al. |
| 5,236,138 | A | | 8/1993 | Stangenberg et al. |
| 5,268,553 | A | | 12/1993 | Shimoji |
| 5,269,473 | A | | 12/1993 | Strohmeyer et al. |
| 5,275,342 | A | | 1/1994 | Galanty |
| 5,279,467 | A | | 1/1994 | Lydy |
| 5,295,633 | A | | 3/1994 | Kimbro et al. |
| 5,318,229 | A | | 6/1994 | Brown |
| D348,431 | S | | 7/1994 | Hoffman et al. |
| 5,345,138 | A | | 9/1994 | Mukaidono et al. |
| 5,356,286 | A | | 10/1994 | Sher |
| 5,397,890 | A | | 3/1995 | Schueler et al. |
| 5,407,346 | A | | 4/1995 | Sher |
| 5,421,720 | A | | 6/1995 | Sher |
| 5,432,308 | A | | 7/1995 | Howie, Jr. |
| 5,436,613 | A | | 7/1995 | Ghosh |
| 5,460,516 | A | | 10/1995 | Sher |
| 5,494,229 | A | | 2/1996 | Rokos et al. |
| 5,568,895 | A | | 10/1996 | Webb et al. |
| 5,607,295 | A | | 3/1997 | Khemarangsan |
| 5,621,290 | A | | 4/1997 | Heller et al. |
| 5,636,801 | A | | 6/1997 | Kroger |
| 5,655,725 | A | | 8/1997 | Kroger |
| 5,662,280 | A | | 9/1997 | Nishio et al. |
| 5,667,152 | A | | 9/1997 | Mooring |
| 5,680,999 | A | | 10/1997 | Wada |
| 5,704,776 | A | | 1/1998 | Sher |
| 5,724,737 | A | | 3/1998 | Stones |
| 5,775,605 | A | | 7/1998 | Tsai |
| 5,788,476 | A | | 8/1998 | Sher |
| 5,829,697 | A | | 11/1998 | Kroger |
| 5,829,963 | A | | 11/1998 | Ichikawa |
| 5,850,342 | A | | 12/1998 | Nakamura et al. |
| 5,868,242 | A | | 2/1999 | Hall et al. |
| 5,884,855 | A | | 3/1999 | Chang |
| 5,897,065 | A | | 4/1999 | Schwelling |
| 5,921,367 | A | | 7/1999 | Kashioka et al. |
| D412,716 | S | | 8/1999 | Kroger |
| 5,942,975 | A | | 8/1999 | S.o slashed.rensen |
| 5,988,542 | A | | 11/1999 | Henreckson et al. |
| 6,065,596 | A | | 5/2000 | Cavanagh |
| 6,065,696 | A | | 5/2000 | Tsai |
| 6,079,645 | A | | 6/2000 | Henreckson et al. |
| 6,082,643 | A | | 7/2000 | Kovacs |
| 6,082,644 | A | | 7/2000 | Turner |
| 6,089,482 | A | | 7/2000 | Chang |
| 6,113,017 | A | | 9/2000 | Tsai |
| 6,116,528 | A | | 9/2000 | Schwelling |
| 6,247,828 | B1 | | 6/2001 | Herst |
| D444,809 | S | | 7/2001 | Chang |
| 6,260,780 | B1 | | 7/2001 | Kroger et al. |
| 6,265,682 | B1 | | 7/2001 | Lee |
| 6,274,828 | B1 | | 8/2001 | Chu |
| 6,308,904 | B1 | | 10/2001 | Chang |
| 6,325,309 | B1 | | 12/2001 | Chang |
| 6,340,124 | B1 | | 1/2002 | Charles et al. |
| 6,376,939 | B1 | | 4/2002 | Suzuki et al. |
| 6,418,004 | B1 | | 7/2002 | Mather et al. |
| 6,501,198 | B2 | | 12/2002 | Taylor et al. |
| 6,536,536 | B1 | | 3/2003 | Gass et al. |
| 6,550,701 | B1 | | 4/2003 | Chang |
| 6,575,285 | B2 | | 6/2003 | Jong |
| D481,416 | S | | 10/2003 | Chang |
| 6,629,654 | B2 | | 10/2003 | Neely et al. |
| 6,655,943 | B1 | | 12/2003 | Peterson et al. |
| 6,676,050 | B2 | | 1/2004 | Chang |
| 6,676,460 | B1 | | 1/2004 | Motsenbocker |
| 6,724,324 | B1 | | 4/2004 | Lambert |
| D494,607 | S | | 8/2004 | Huang |
| 6,775,018 | B1 | | 8/2004 | Taniguchi |
| 6,779,747 | B2 | | 8/2004 | McLean et al. |
| 6,813,983 | B2 | | 11/2004 | Gass et al. |
| 6,822,698 | B2 | | 11/2004 | Clapper |
| 6,826,988 | B2 | | 12/2004 | Gass et al. |
| 6,834,730 | B2 | | 12/2004 | Gass et al. |
| 6,857,345 | B2 | | 2/2005 | Gass et al. |
| D502,713 | S | | 3/2005 | Huang |
| D502,714 | S | | 3/2005 | Huang |
| 6,877,410 | B2 | | 4/2005 | Gass et al. |
| 6,880,440 | B2 | | 4/2005 | Gass et al. |
| 6,920,814 | B2 | | 7/2005 | Gass et al. |
| 6,922,153 | B2 | | 7/2005 | Pierga et al. |
| 6,945,148 | B2 | | 9/2005 | Gass et al. |
| 6,945,149 | B2 | | 9/2005 | Gass et al. |

| | | | |
|---|---|---|---|
| 6,957,601 | B2 | 10/2005 | Gass et al. |
| 6,962,301 | B1 | 11/2005 | Chang |
| 6,966,513 | B2 | 11/2005 | Chang |
| 6,976,648 | B2 | 12/2005 | Chang |
| 6,978,954 | B2 | 12/2005 | Kroger et al. |
| 6,979,813 | B2 | 12/2005 | Avril |
| 6,981,667 | B2 | 1/2006 | Hunag |
| 6,983,903 | B2 | 1/2006 | Chang |
| 6,994,004 | B2 | 2/2006 | Gass et al. |
| 6,997,090 | B2 | 2/2006 | Gass et al. |
| 7,000,514 | B2 | 2/2006 | Gass et al. |
| 7,024,975 | B2 | 4/2006 | Gass et al. |
| 7,040,559 | B2 | 5/2006 | Matlin et al. |
| 7,044,410 | B2 | 5/2006 | Hunag |
| 7,048,218 | B2 | 5/2006 | Hunag |
| 7,055,417 | B1 | 6/2006 | Gass |
| 7,077,039 | B2 | 7/2006 | Gass et al. |
| 7,083,129 | B2 | 8/2006 | Beam, III |
| 7,093,668 | B2 | 8/2006 | Gass et al. |
| 7,098,800 | B2 | 8/2006 | Gass |
| 7,100,483 | B2 | 9/2006 | Gass et al. |
| 7,121,358 | B2 | 10/2006 | Gass et al. |
| 7,137,326 | B2 | 11/2006 | Gass et al. |
| 7,150,422 | B2 | 12/2006 | Wang |
| 7,171,879 | B2 | 2/2007 | Gass et al. |
| 7,171,897 | B2 | 2/2007 | Barajas et al. |
| 7,195,185 | B2 | 3/2007 | Matlin |
| 7,197,969 | B2 | 4/2007 | Gass et al. |
| 7,210,383 | B2 | 5/2007 | Gass et al |
| 7,225,712 | B2 | 6/2007 | Gass et al. |
| 7,228,772 | B2 | 6/2007 | Gass |
| 7,231,856 | B2 | 6/2007 | Gass et al. |
| 7,284,467 | B2 | 10/2007 | Gass et al. |
| 7,290,472 | B2 | 11/2007 | Gass et al. |
| 7,308,843 | B2 | 12/2007 | Gass et al. |
| 7,311,276 | B2 | 12/2007 | Matlin |
| 7,328,752 | B2 | 2/2008 | Gass et al. |
| 7,344,096 | B2 | 3/2008 | Matlin et al. |
| D583,859 | S | 12/2008 | Holderfield |
| D584,342 | S | 1/2009 | Parratt |
| D591,335 | S | 4/2009 | Holderfield et al. |
| 7,631,822 | B2 | 12/2009 | Matlin et al. |
| 7,631,823 | B2 | 12/2009 | Matlin et al. |
| 7,631,824 | B2 | 12/2009 | Matlin et al. |
| 7,635,102 | B2 | 12/2009 | Matlin et al. |
| 7,721,982 | B2 * | 5/2010 | Schwelling et al. ..... 241/100 |
| 7,828,235 | B2 | 11/2010 | Matlin et al. |
| 2001/0030114 | A1 | 10/2001 | Thielman |
| 2002/0002942 | A1 | 1/2002 | Abraham et al. |
| 2002/0017175 | A1 | 2/2002 | Gass et al. |
| 2002/0017176 | A1 | 2/2002 | Gass et al. |
| 2002/0017178 | A1 | 2/2002 | Gass et al. |
| 2002/0017179 | A1 | 2/2002 | Gass et al. |
| 2002/0017180 | A1 | 2/2002 | Gass et al. |
| 2002/0017181 | A1 | 2/2002 | Gass et al. |
| 2002/0017182 | A1 | 2/2002 | Gass et al. |
| 2002/0017183 | A1 | 2/2002 | Gass et al. |
| 2002/0017184 | A1 | 2/2002 | Gass et al. |
| 2002/0017336 | A1 | 2/2002 | Gass et al. |
| 2002/0020261 | A1 | 2/2002 | Gass et al. |
| 2002/0020262 | A1 | 2/2002 | Gass et al. |
| 2002/0020263 | A1 | 2/2002 | Gass et al. |
| 2002/0020265 | A1 | 2/2002 | Gass et al. |
| 2002/0056348 | A1 | 5/2002 | Gass et al. |
| 2002/0056349 | A1 | 5/2002 | Gass et al. |
| 2002/0056350 | A1 | 5/2002 | Gass et al. |
| 2002/0059853 | A1 | 5/2002 | Gass et al. |
| 2002/0059854 | A1 | 5/2002 | Gass et al. |
| 2002/0059855 | A1 | 5/2002 | Gass et al. |
| 2002/0066346 | A1 | 6/2002 | Gass et al. |
| 2002/0069734 | A1 | 6/2002 | Gass et al. |
| 2002/0111702 | A1 | 8/2002 | Angel |
| 2002/0139877 | A1 | 10/2002 | Beam |
| 2002/0170399 | A1 | 11/2002 | Gass et al. |
| 2002/0170400 | A1 | 11/2002 | Gass |
| 2002/0190581 | A1 | 12/2002 | Gass et al. |
| 2003/0002942 | A1 | 1/2003 | Gass et al. |
| 2003/0005588 | A1 | 1/2003 | Gass et al. |
| 2003/0015253 | A1 | 1/2003 | Gass et al. |
| 2003/0019341 | A1 | 1/2003 | Gass et al. |
| 2003/0037651 | A1 | 2/2003 | Gass et al. |
| 2003/0056853 | A1 | 3/2003 | Gass et al. |
| 2003/0058121 | A1 | 3/2003 | Gass et al. |
| 2003/0090224 | A1 | 5/2003 | Gass et al. |
| 2003/0090226 | A1 | 5/2003 | Chen et al. |
| 2003/0196824 | A1 | 10/2003 | Gass et al. |
| 2004/0008122 | A1 | 1/2004 | Michael |
| 2004/0040426 | A1 | 3/2004 | Gass et al. |
| 2004/0043696 | A1 | 3/2004 | Suzuki |
| 2004/0163514 | A1 | 8/2004 | Gass et al. |
| 2004/0173430 | A1 | 9/2004 | Gass |
| 2004/0181951 | A1 | 9/2004 | Wittke |
| 2004/0194594 | A1 | 10/2004 | Dils et al. |
| 2004/0226800 | A1 | 11/2004 | Pierga et al. |
| 2005/0039586 | A1 | 2/2005 | Gass et al. |
| 2005/0039822 | A1 | 2/2005 | Gass et al. |
| 2005/0041359 | A1 | 2/2005 | Gass |
| 2005/0132859 | A1 | 6/2005 | Hunag |
| 2005/0157203 | A1 | 7/2005 | Nakakuki et al. |
| 2005/0166736 | A1 | 8/2005 | Gass et al. |
| 2005/0218250 | A1 | 10/2005 | Matlin et al. |
| 2005/0274834 | A1 | 12/2005 | Huang |
| 2005/0274836 | A1 | 12/2005 | Chang |
| 2006/0091247 | A1 | 5/2006 | Matlin |
| 2006/0157600 | A1 | 7/2006 | Wang |
| 2006/0169619 | A1 | 8/2006 | Wang |
| 2006/0249609 | A1 | 11/2006 | Huang |

FOREIGN PATENT DOCUMENTS

| | | |
|---|---|---|
| CN | 2383583 | 6/2000 |
| DE | 3733413 | 3/1943 |
| DE | 7818838 | 11/1979 |
| DE | 3247299 | 7/1984 |
| DE | 3313232 | 10/1984 |
| DE | 3208676 | 4/1986 |
| DE | 3540896 | 5/1987 |
| DE | 8619856 | 9/1988 |
| DE | 8619856.4 | 10/1988 |
| DE | 3819285 | 12/1989 |
| DE | 4014669 | 11/1991 |
| DE | 4121330 | 1/1993 |
| DE | 19519858 | 5/1996 |
| DE | 19703575 | 8/1998 |
| DE | 19960267 | 7/2000 |
| EP | 0191137 | 8/1986 |
| EP | 0511535 | 4/1992 |
| EP | 00522071 | 5/1993 |
| EP | 0562076 | 9/1993 |
| EP | 0736886 | 10/1996 |
| EP | 855221 | 7/1998 |
| EP | 0855221 | 7/1998 |
| EP | 1069954 | 1/2001 |
| EP | 1195202 | 4/2002 |
| EP | 1442834 | 4/2004 |
| GB | 2096919 | 10/1982 |
| GB | 2199962 | 7/1988 |
| GB | 2203063 | 10/1988 |
| GB | 2234690 | 2/1991 |
| JP | 52011691 | 1/1977 |
| JP | 57076734 | 5/1982 |
| JP | 62146877 | 6/1987 |
| JP | 3143552 | 6/1991 |
| JP | 4110143 | 4/1992 |
| JP | 03143552 | 5/1992 |
| JP | 04110143 | 5/1992 |
| JP | 04157093 | 5/1992 |
| JP | 04180852 | 6/1992 |
| JP | 05014164 | 1/1993 |
| JP | 05068906 | 3/1993 |
| JP | 05092144 | 4/1993 |
| JP | 05123593 | 5/1993 |
| JP | 05211691 | 8/1993 |
| JP | 05280243 | 10/1993 |
| JP | 06137104 | 5/1994 |
| JP | 06277548 | 10/1994 |
| JP | 07039778 | 5/1995 |
| JP | 07136539 | 5/1995 |
| JP | 07155629 A2 | 6/1995 |

| | | | |
|---|---|---|---|
| JP | 07157012 | A2 | 6/1995 |
| JP | 07299377 | A2 | 11/1995 |
| JP | 07328469 | A2 | 12/1995 |
| JP | 8001026 | | 1/1996 |
| JP | 09070551 | A2 | 3/1997 |
| JP | 09075763 | A2 | 3/1997 |
| JP | 09139161 | A2 | 5/1997 |
| JP | 09262491 | A2 | 10/1997 |
| JP | 10-048344 | | 2/1998 |
| JP | 10034003 | A2 | 2/1998 |
| JP | 10-089592 | | 4/1998 |
| JP | 11216383 | A2 | 8/1999 |
| JP | 20076014 | | 3/2000 |
| JP | 20346288 | | 12/2000 |
| JP | 2001150383 | A2 | 6/2001 |
| JP | 2001-349139 | | 12/2001 |
| JP | 21349139 | | 12/2001 |
| JP | 24321993 | | 11/2004 |
| JP | 200432199 | A2 | 11/2004 |
| JP | 26075831 | | 3/2006 |
| JP | 2007-075822 | | 3/2007 |
| JP | 27075822 | | 3/2007 |
| WO | WO8403650 | | 9/1984 |
| WO | WO9101860 | | 2/1991 |
| WO | WO92/00159 | | 1/1992 |
| WO | WO9306570 | | 4/1993 |
| WO | WO9308356 | | 4/1993 |
| WO | WO94/13441 | | 6/1994 |
| WO | WO9413441 | | 6/1994 |
| WO | WO9613362 | | 5/1996 |
| WO | WO9637350 | | 11/1996 |
| WO | WO9852728 | | 11/1998 |
| WO | WO0048283 | | 8/2000 |
| WO | WO02060588 | | 8/2002 |
| WO | WO02/082613 | | 10/2002 |
| WO | WO03/006213 | | 1/2003 |
| WO | WO2005-084861 | | 9/2005 |
| WO | WO2005097331 | | 10/2005 |
| WO | WO2005107951 | | 11/2005 |
| WO | WO2006049784 | | 1/2006 |
| WO | PCT/US2005/028290 | | 3/2006 |
| WO | WO2006/031324 | | 3/2006 |
| WO | WO2006031324 | | 3/2006 |
| WO | WO2006074122 | | 7/2006 |
| WO | WO2007/060698 | | 5/2007 |
| WO | WO2007/109753 | | 9/2007 |
| WO | WO2008/011517 | | 1/2008 |
| WO | WO2008/014276 | | 1/2008 |
| WO | WO2008/042538 | | 4/2008 |
| WO | WO2008/064392 | | 6/2008 |

OTHER PUBLICATIONS

D.S. Chauhan & P.H. Dehoff, a magneto-sensitive skin for robots in space, Dept. of Mechanical Engineering & Engineering Science University of North Carolina at Charlotte, Jul. 1991.

Thomas G. Zimmerman et al., applying electric field sensing to human-computer interfaces, MIT Media Laboratory Physics and Media Group.

Proximity Sensors (book), Festo Didactic, Germany 2003.

Lennart Bavall & Nils Karlsson, capacitive detection of humans for safety in idustry-a numerical and experimental investigation, Linkoping Institute of Tech., Sweden Oct. 1997.

concepts and techniques of machine safeguarding, US Dept. of Labor, OSHA 3067, 1992.

Designing a safe highly productive system, thefabricator.com, May 30, 2002.

Joshua Smith et al., Electric Field Sensing for graphical interfaces, May/Jun. 1998.

TI's Digital signal Controllers put brake on sawtop table saw, www.embeddedstar.com, 2005.

Doubled productivity reduced product damage, Gorbel Inc., 2003.

Andrew J. Scarlett et al., Guard interlockling for self-propelled harvesting machinery, Silsoe Research Institute, HSE Book 2002.

Industrial Guarding Program Energy Sources Machinery Equipment and Materials, OFSWA Sep. 2002 Version 1.0.

Navigating the maze of proximit sensor selection, Allen-Bradley, Sensors Today, vol. 2 Issue 1.

The Limitations of Radiofrequency Presence Sensing Device, US Dept. of Labor, OSHA, Sep. 21, 1987.

Charge-Transfer Touch Sensor, Quantum Research Group Ltd, 2001.

Safety Mats, Presence Sensing Safety Devices, Allen-Bradley, 2-72.

Tom Begnal, Sawstop and bandsaws might soon be an option, Taunton 2008.

Safeguarding woodworking machines and worker safety, tablesaw blade safety device, WOODWEB forum, 2008.

Nils Karlsson, Theory and application of a capacitive sensor for safeguarding in industry, Dept. of Physics and Measurement Techology, Mar. 1994.

* cited by examiner

PINS OR STAPLES REMOVABLE STRUCTURE OF AUTOMATIC SHREDDERS

TECHNOLOGY FIELD

The present invention relates to the field of shredders, especially to the field of automatic shredders, in particular to a pins or staples removable structure of automatic shredders.

BACKGROUND TECHNOLOGY

At present, the principle of the automatic paper feeding device of the known automatic shredders is same to that of the pick-up box of printers. That application is the most common for the structure is relatively simple. Though its principle is same to that of printers, the stack of paper to be shredded by shredders is unlike the paper used in printers, has tilted corners, and has many waste files the pieces of paper of each of which are bound into a stack by staples or pins, thus the situation that with the automatic shredder bought to shred paper the number of paper should be chosen occurs. And there often occurs the situation that the shredder is smooth on trial when the user wants to buy it, but in normal uses paper jams and can not be taken out, and the pick-up mechanism would be broken if the paper is taken out forcely. Such a situation limits severely the application of these automatic shredders.

In addition, the sizes of the cutting blades, the strength of the cutter shaft the cutting blades are mounted on, and the load of the driving motor of one shredder restrict the largest number of paper the shredder can accommodate at a single time. For example, 3, 5, 8, 10, 12, 20 and so on are indicated on the shredder panel, then when the number of paper to be shredded is more than the above limited number, the paper can only be counted and divided into several stacks to be shredded one by one manually, even if the shredder has the function of shredding pins or staples, the pieces of paper also should be disconnected and counted to be divided into several stacks each less than the predetermined largest number to be fed. The number indicated is bigger, the size of the motor and the cutting blades are bigger, and then the cost pressure is greater.

The research of automatic shredders is a new topic that should be studied deeply for users to help them shred relatively more pieces of paper, save costs and save energy really. And that the automatic shredders can shred a stack of paper with pins or staples is even a directional topic that the application of automatic shredders enters into a deeper level.

In order to solve the problems existed in the application of automatic shredders and make buyers use them more conveniently, after a long term study and test, the structure of the present patent solves the above mentioned problems preferably.

DISCLOSURE OF THE INVENTION

Aspects of the present invention generally pertain to a pins or staples removable structure of automatic shredders, which, cooperated with the shredding structure of automatic shredders, can remove automatically pins or staples of paper having pins or staples mixed in a stack of paper, to achieve shredding paper in batches, has a high degree of automation, can be used conveniently, is designed dexterously, and has a concise structure and an economical cost.

In order to realize the above aims, the pins or staples removable structure of automatic shredders of the present invention has the following structures:

In an aspect, the pins or staples removable structure of automatic shredders comprises a shredder core, a paper press board assembly and a paper support board assembly fixed to the shredder core and arranged cooperatedly, the paper support board assembly comprises a paper support board and a pick-up mechanism mounted to the paper support board, and the pins or staples removable structure of automatic shredders further comprises a clamping device fixed to the paper press board assembly and the shredder core/the paper support board respectively, for clamping the paper to be shredded to the paper support board during the process of shredding paper.

In a further aspect, the clamping device is an elastic component two ends of which are fixed to the paper press board assembly and the shredder core respectively.

In yet another aspect, the elastic component is an extension spring.

In a further aspect, the distance between the outer end of the paper support board for clamping the paper to be shredded and the outer end of the pick-up mechanism for clamping the paper to be shredded is less than the length of the whole paper to be shredded.

In a further aspect, the pick-up mechanism comprises a pick-up axle mounted in the paper support board, and the paper press board assembly comprises a paper press board and a paper press axle mounted in the paper press board and adjacent to the pick-up axle.

In yet another aspect, around the pick-up axle is mounted a pick-up roller, and around the paper press axle is mounted a paper press roller next to the pick-up roller.

In yet another aspect, in the middle part of the paper support board there is a groove in which the pick-up axle is located, the top of the cross section of the pick-up axle is higher than the upper surface of the paper support board.

In a further aspect, the paper press board further has a paper inlet above the blade assembly of the shredder core.

In yet another aspect, the pins or staples removable structure of automatic shredders further comprises a magnet positioned in the outer end of the paper support board.

In yet another aspect, the magnet is a magnetic strip, the outer end has a slot for the magnetic strip in which the magnetic strip is located, and the magnetic strip is lower than the upper surface of the paper support board.

With the present invention, for the extension spring of the present invention, through acting on the paper press board, clamps the stack of paper to be shredded between the paper press board and the paper support board to the paper support board, with the motion of the pick-up mechanism, the bottommost sheet of the stack of paper is moved to be pulled into the blade assembly by the knifepoints of the blades of the shredder core at the paper inlet in the paper support board to be shredded, when a stack of paper with pins or staples exists, for the paper support board is pulled tightly to the paper press board by the extension spring and the bookbinding side of the stack of paper protrudes out of the paper support board, the bottommost sheet of the stack of paper rolled up is pulled into the blade assembly by the knifepoints of the blades, and its bookbinding side is rolled up to and removed by the outer end of the paper press board, so as to achieve removing pins or staples and shredding paper with pins or staples, thus to solve the above mentioned application problems, so the present invention has a high degree of automation, can be used conveniently, is designed dexterously, and has a concise structure and an economical cost.

PREFERRED EMBODIMENTS OF THE INVENTION

Figure 1:
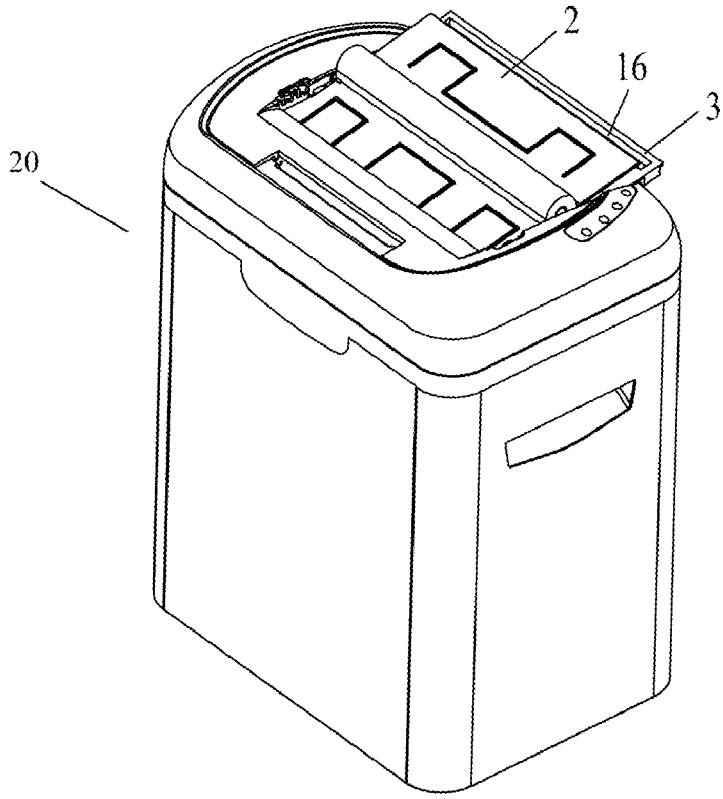
FIG. 1 is a schematic view of the appearance of the automatic shredder with one embodiment of the present invention.
Figure 2:
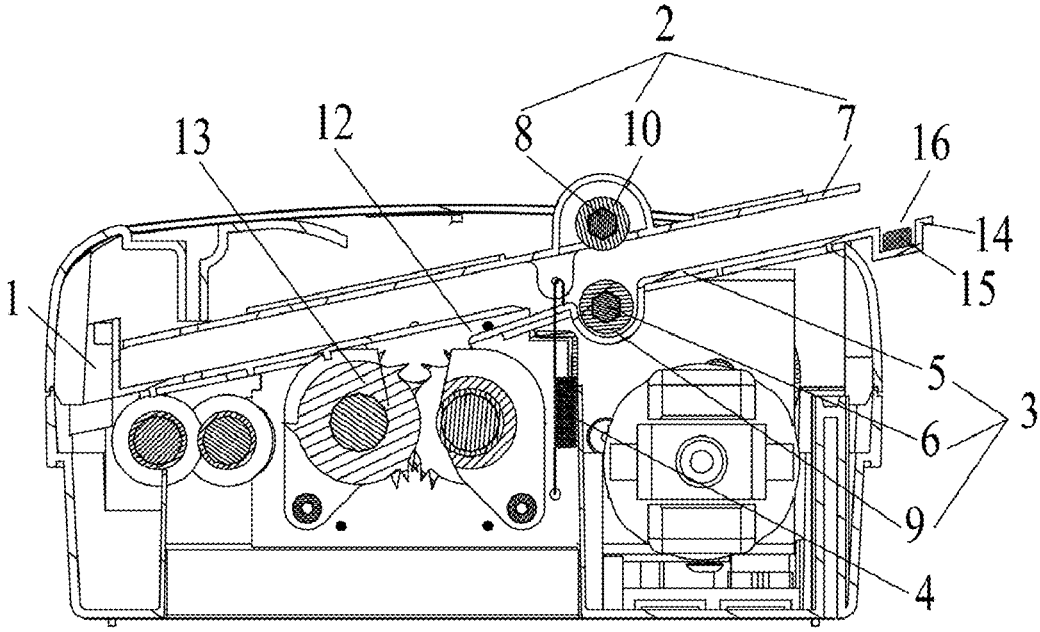
FIG. 2 is a cutaway schematic view of the partial inner structure of the automatic shredder shown in FIG. 1.
Figure 3:
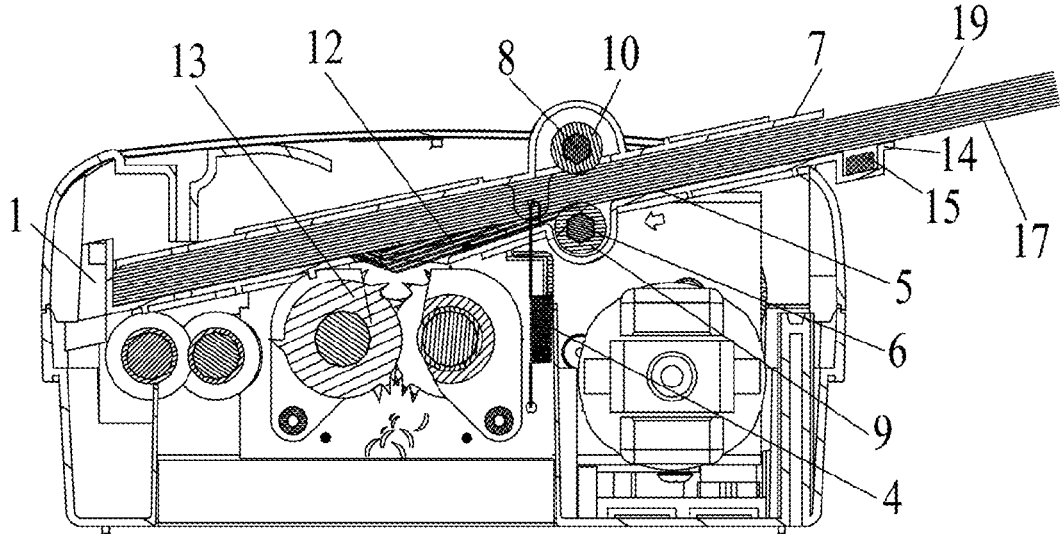
FIG. 3 is a schematic view of the working principle of removing pins or staples of the present invention.

In order to understand the technical content of the present invention more clearly, the present invention would be exemplified further by reference to the following embodiments.

Please refer to FIGS. 1~4, the pins or staples removable structure of automatic shredders of the present invention comprises a shredder core 1, a paper press board assembly 2 and a paper support board assembly 3 fixed to the shredder core 1 and arranged cooperatedly, and a clamping device 4, the paper support board assembly 3 comprises a paper support board 5 and a pick-up mechanism mounted to the paper support board 5, the clamping device 4 is fixed to the paper press board assembly 2 and the shredder core 1/the paper support board 5 respectively, for clamping the paper to be shredded to the paper support board 5 during the process of shredding paper.

Preferably, the clamping device 4 is an elastic component two ends of which are fixed to the paper press board assembly 2 and the shredder core 1 respectively.

In the present embodiment of the present invention, the elastic component is an extension spring.

The above mentioned clamping device can be an extension spring, or a clip-like device for clamping the paper press board and the paper support board, or a top press device with an extension spring, for example, on one hand one spring would pull the paper press board to make it be close to the paper support board, on the other hand another spring would support the paper support board to make it be close to the paper press board, or two top press devices press the paper press board and the paper support board respectively to make them be close to each other, and so on, therefore various structures can be adopted to clamp the paper press board and the paper support board.

In the present embodiment of the present invention, the distance between the outer end 14 of the paper support board 5 for clamping the paper to be shredded and the outer end of the pick-up mechanism for clamping the paper to be shredded is less than the length of the whole paper to be shredded. Thus when the stack of paper to be shredded in which paper with pins or staples is mixed is placed, the bookbinding side of the paper protrudes out of the paper support board 5 to facilitate removing pins or staples. Though the pins or staples can also be removed if the bookbinding side of the paper does not protrude out of the paper support board 5, that depends mainly on the pulling force, without the stopping force of the outer end 14 of the paper support board 5, it is not very easy to remove pins or staples.

Preferably, the pick-up mechanism comprises a pick-up axle 6 mounted in the paper support board 5, and the paper press board assembly 2 comprises a paper press board 7 and a paper press axle 8 mounted in the paper press board 7 and adjacent to the pick-up axle 6.

In the present embodiment of the present invention, around the pick-up axle 6 is mounted a pick-up roller 9, and around the paper press axle 8 is mounted a paper press roller 10 next to the pick-up roller 9.

In the present embodiment of the present invention, in the middle part of the paper support board 5 there is a groove 11 in which the pick-up axle 6 is located, the top of the cross section of the pick-up axle 6 is higher than the upper surface of the paper support board 5.

In the present embodiment of the present invention, the paper press board 5 further has a paper inlet 12 above the blade assembly 13 of the shredder core 1. Apparently, the paper press board 5 can have no paper inlet 12, its end near to the blade assembly 13 extends aslant to the position above the blade assembly 13 to cause the paper moved to enter into the shredding blades directly.

More preferably, the pins or staples removable structure of automatic shredders further comprises a magnet 15 positioned in the outer end 14 of the paper support board 5.

In the present embodiment of the present invention, the magnet 15 is a magnetic strip, the outer end 14 has a slot 16 for the magnetic strip in which the magnetic strip is located, and the magnetic strip is lower than the upper surface of the paper support board 5. Therefore pins or staples removed can be captured by the magnetic strip and blocked in the slot 16 for the magnetic strip.

The paper press board assembly 2 and the paper support board assembly 3 of the present invention had better be mounted aslant on the shredder core 1, that is, aslant to the shredding blade shaft. The paper press assembly 2 can be fixed on the paper support board 5 in the machine, or combined with the turnover lid structure to be integrated with the upper lid of the whole machine.

Figure 4:
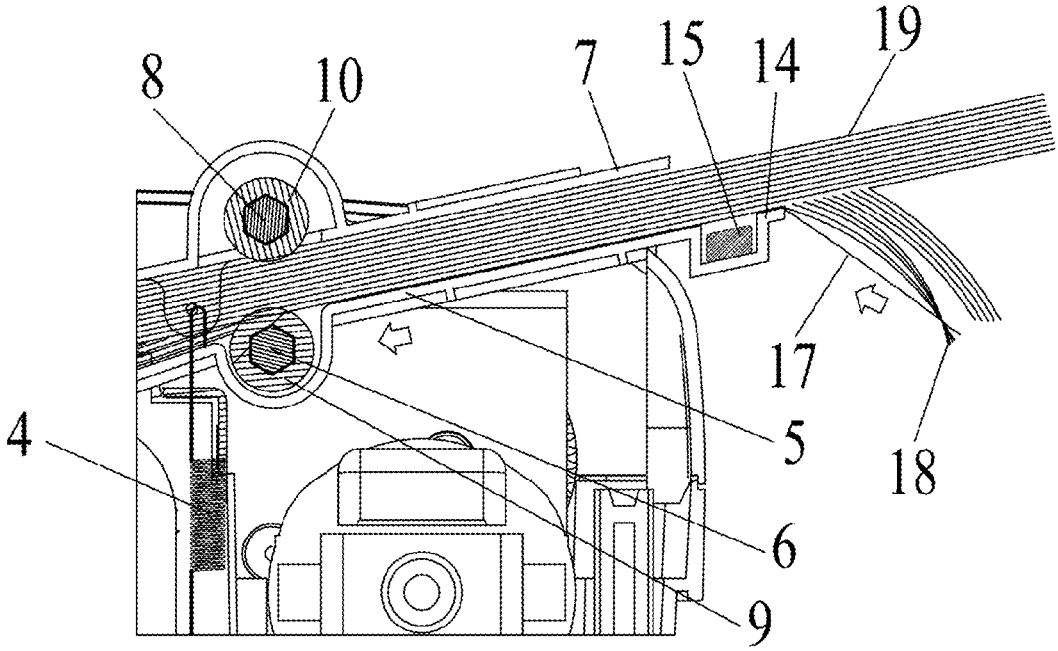
FIG. 4 is a schematic view of the movement of the paper during the use of the present invention.

When the present invention is used, the stack of paper to be shredded is placed between the paper press board assembly 2 and the paper support board assembly 3, its bookbinding side or side having pins protrudes out of the paper support board 5, under the role of the extension spring the paper press board 7 press the stack of paper tightly to the paper support board 5, and the paper press roller 10 presses and retains the paper to be shredded, then the shredder 20 is started to rotate the shredding blades, the pick-up roller 9 is also rotated, and can be driven by driving the pick-up axle 6 with an motor, or with the blade shaft of the blade assembly 13 through the driving gear, so as to move the bottommost sheet 17 of the stack of paper which would be pulled into the blade assembly 13 by the knifepoints of the blades at the paper inlet 12 to be shredded; when the bottommost sheet 17 is bound or pined to several pieces of paper above, they would move along the direction indicated by the arrow shown in FIG. 4, for the stack of paper having paper with pins or staples is pressed tightly to the paper support board 5 by the extension spring on the paper press board 7, and the lower end of the extension spring is fixed to the baseplate of the shredder core 1, the upper sheets 19 also apply one force to the lower sheets 18 pulled, the bottommost sheet 17 is pulled into the blades by the blade assembly 13 to be shredded, the lower sheets 18 are then rolled up and retained by the outer end 14 of the paper support board 5 when they pass through the outer end 14, till the bottommost sheet 17 is shredded completely, through repeating the above steps, the next sheet of paper can be shredded, finally all pieces of paper bound together can be shredded. The more the pieces of paper bound together are, the bigger the retaining force is when the pieces of paper are rolled up, thus the easier the removing of pins or staples is. The pins or staples removed are captured by the magnetic strip into the slot 16 for the magnetic strip. Thus the function of removing pins or staples is achieved.

The present invention can facilitate the user to shred relative more pieces of paper automatically at one time, and to shred paper in batches, at the same time save the cost to save energy really.

To sum up, the pins or staples removable structure of automatic shredders of the present invention, cooperated with the shredding structure of automatic shredders, can remove automatically pins or staples of paper having pins or staples mixed in a stack of paper, to achieve shredding paper in batches, has a high degree of automation, can be used conveniently, is designed dexterously, and has a concise structure and an economical cost.

While the present invention has been particularly shown and described with references to preferred embodiments thereof, it will be understood by those skilled in the art that various changes in form and details may be made therein without departing from the spirit and scope of the invention as defined by the claims. It is clearly understood therefore that the same is by way of illustration and example only and is not to be taken by way of limitation.

I claim:

1. A pins or staples removable structure of automatic shredders, comprising a shredder core, a paper press board assembly and a paper support board assembly fixed to the shredder core and arranged cooperatedly, the paper support board assembly comprises a paper support board and a pick-up mechanism mounted to the paper support board, wherein the pins or staples removable structure of automatic shredders further comprises a clamping device fixed to the paper press board assembly and the shredder core/the paper support board respectively, for clamping the paper to be shredded to the paper support board during the process of shredding paper.

2. The pins or staples removable structure of automatic shredders according to claim 1, wherein the clamping device is an elastic component two ends of which are fixed to the paper press board assembly and the shredder core respectively.

3. The pins or staples removable structure of automatic shredders according to claim 2, wherein the elastic component is an extension spring.

4. The pins or staples removable structure of automatic shredders according to claim 1, wherein the distance between the outer end of the paper support board for clamping the paper to be shredded and the outer end of the pick-up mechanism for clamping the paper to be shredded is less than the length of the whole paper to be shredded.

5. The pins or staples removable structure of automatic shredders according to claim 1, wherein the pick-up mechanism comprises a pick-up axle mounted in the paper support board, and the paper press board assembly comprises a paper press board and a paper press axle mounted in the paper press board and adjacent to the pick-up axle.

6. The pins or staples removable structure of automatic shredders according to claim 5, wherein around the pick-up axle is mounted a pick-up roller, and around the paper press axle is mounted a paper press roller next to the pick-up roller.

7. The pins or staples removable structure of automatic shredders according to claim 5, wherein in the middle part of the paper support board there is a groove in which the pick-up axle is located, the top of the cross section of the pick-up axle is higher than the upper surface of the paper support board.

8. The pins or staples removable structure of automatic shredders according to claim 1, wherein the paper press board further has a paper inlet above the blade assembly of the shredder core.

9. The pins or staples removable structure of automatic shredders according to claim 8, wherein the pins or staples removable structure of automatic shredders further comprises a magnet positioned in the outer end of the paper support board.

10. The pins or staples removable structure of automatic shredders according to claim 9, wherein the magnet is a magnetic strip, the outer end has a slot for the magnetic strip in which the magnetic strip is located, and the magnetic strip is lower than the upper surface of the paper support board.

* * * * *